US005715505A

United States Patent [19]

Tombs et al.

[11] Patent Number: 5,715,505

[45] Date of Patent: Feb. 3, 1998

[54] IMAGE FORMING METHOD AND APPARATUS UTILIZING A COMPLIANT IMAGE MEMBER

[75] Inventors: Thomas N. Tombs, Brockport; John W. May, Rochester, both of N.Y.

[73] Assignee: Eastman Kodak Company, Rochester, N.Y.

[21] Appl. No.: 655,787

[22] Filed: May 30, 1996

[51] Int. Cl.[6] ..... G03G 15/01

[52] U.S. Cl. ..... 399/299; 399/298; 399/302

[58] Field of Search ..... 399/301, 302, 399/308, 299, 159, 298; 430/126, 44, 56, 60, 62

[56] References Cited

U.S. PATENT DOCUMENTS

| | | | |
|---|---|---|---|
| 4,531,825 | 7/1985 | Miwa et al. . | |
| 5,001,028 | 3/1991 | Mosehauer et al. | 430/45 |
| 5,070,372 | 12/1991 | Randall | 399/231 |
| 5,075,730 | 12/1991 | Hoshi | 399/302 |
| 5,084,735 | 1/1992 | Rimai et al. . | |
| 5,200,285 | 4/1993 | Carrish | 430/45 |
| 5,206,101 | 4/1993 | Schonenberg | 430/44 |
| 5,243,392 | 9/1993 | Berkes et al. | 399/308 |
| 5,339,146 | 8/1994 | Aslam et al. . | |
| 5,347,353 | 9/1994 | Fletcher . | |
| 5,370,961 | 12/1994 | Zaretsky et al. | 430/126 |
| 5,485,256 | 1/1996 | Randall et al. | 399/308 |
| 5,561,510 | 10/1996 | Kamp et al. . | |

FOREIGN PATENT DOCUMENTS 3-251860 11/1991 Japan .

*Primary Examiner*—Matthew S. Smith
*Attorney, Agent, or Firm*—Norman Rushefsky

[57] ABSTRACT

First and second toner images are formed electrophotographically on first and second photoconductive imaging members, respectively. The first toner image is transferred to the second photoconductive image member in registration with the second toner image to form a combined toner image which may be in two colors. To improve the transfer between the two photoconductive image members, at least one of the photoconductive image members is preferably compliant.

39 Claims, 6 Drawing Sheets

Fig. 1
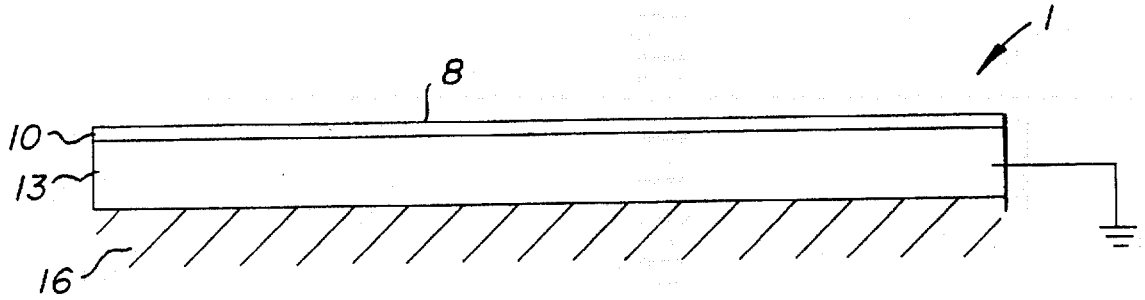
Fig. 2
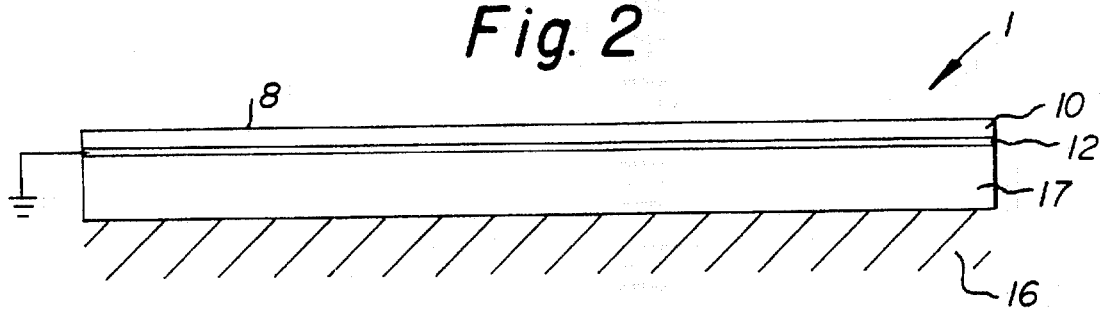
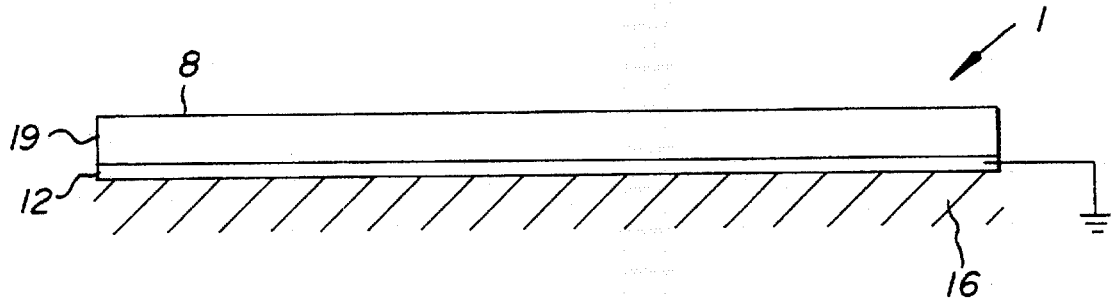
Fig. 3

IMAGE FORMING METHOD AND APPARATUS UTILIZING A COMPLIANT IMAGE MEMBER

CROSS-REFERENCE TO RELATED APPLICATION

This application is related to U.S. application Ser. No. 08/655,656 filed on even date herewith in the names of the inventors hereof.

This invention relates to the formation and transfer of toner images. It is particularly usable in providing combined toner images, for example, toner images made up of more than one type of toner.

U.S. patent application Ser. No. 07/712,017, Jackson et al (see corresponding WIPO Publication US92/04444), shows the use of a compliant roller, pad or coating behind a photoconductive belt to assist thermal transfer of toner images to a receiving sheet carried by a metal roller. The advantage of the compliance behind the photoconductor is that it widens the nip for good thermal transfer allowing use of the hard, thermally conductive roller carrying the receiving paper. See also in this respect, U.S. Pat. No. 5,339,146 and U.S. Pat. No. 4,531,825, which also suggest some advantage in compliance associated with a photoconductive image member in transferring to a hard intermediate that is heated.

U.S. patent application Ser. No. 08/180,580, to Randall et al, discloses the use of a second photoconductive image member ancillary to a primary photoconductive image member in an image forming apparatus. The primary photoconductive image member is used to make black images at high speed and high volume. The secondary photoconductive image member provides accent color toner images which are transferred to the primary image member in registration with the black images.

See also in this respect, U.S. Pat. No. 5,347,353 to Fletcher, issued Sep. 13, 1994, which shows a photoconductive intermediate image member which receives images from a series of photoconductive drums in registration. The photoconductive intermediate member can occasionally be used to add an image to the combined image when an unusual color is desired.

U.S. Pat. No. 5,084,735 to Rimai et al, granted Jan. 28, 1992 suggests an intermediate image member having a compliant base and a very thin, hard outer layer which provides greatly improved electrostatic transfer, especially of fine particle toner images.

SUMMARY OF THE INVENTION

It is an object of the invention to provide an image forming method and apparatus which utilizes a compliant image member, preferably a compliant photoconductive image member to provide improvements in the production of images, preferably combined toner images containing toners of different color.

This and other objects are accomplished by an image forming apparatus which includes first and second photoconductive image members and means for forming a first toner image on the first image member and means for forming a second toner image on the second image member. The apparatus also includes means for transferring the first toner image from the first photoconductive image member to the second photoconductive image member, wherein at least one of the first and second photoconductive image members is compliant.

Although the prior art suggests the use of compliance behind a photoconductive member for thermal transfer to allow use of a hard, metallic, heat conducting roller backing the surface to which the toner is being transferred, we have found that the use of a compliant photoconductive image member improves electrostatic transfer as well. The many advantages that can be obtained by transferring toner images between photoconductive image members are facilitated by this discovery and will be set out in more detail below.

BRIEF DESCRIPTION OF THE DRAWINGS

FIGS. 1, 2 and 3 are cross-sections of alternative compliant photoconductive image members, partially schematic and not drawn to scale.

DESCRIPTION OF THE PREFERRED EMBODIMENTS

Figure 4:
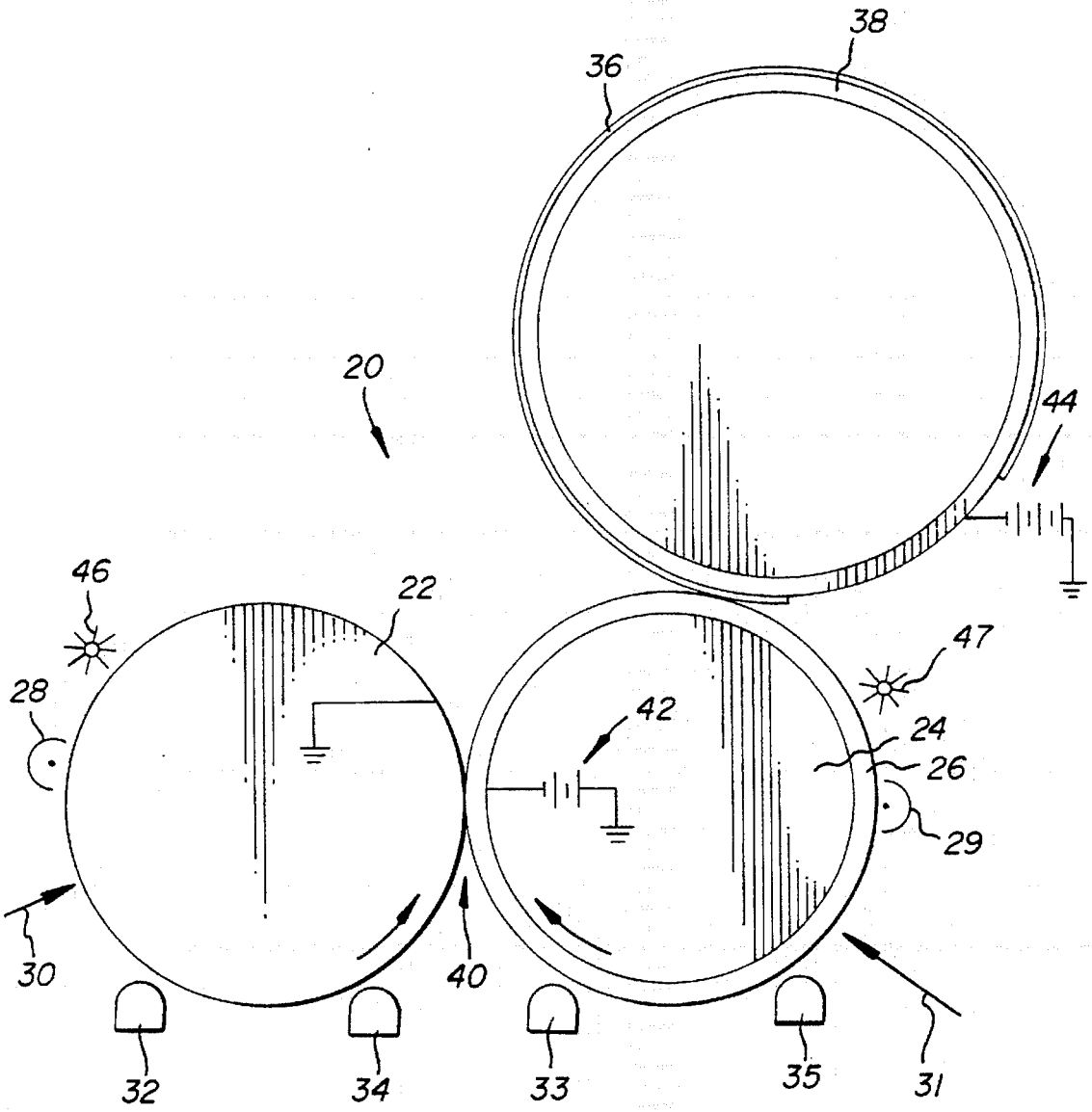
FIGS. 4–8 are side schematics of alternative image forming apparatus.

U.S. patent application Ser. No. 07/712,017, referred to above, suggests several forms of compliant photoconductive image members. They include a drum upon which is wrapped a compliant blanket on top of which is wrapped a conventional web photoconductive image member, including generally a polyester support, a thin conductive layer and a photoconductive layer. While these photoconductive image members from the prior art work well in those applications and would provide some advantages in the electrostatic applications described below, embodiments described in FIGS. 1–3 provide much superior results.

The compliant photoconductive image member used in this invention can be in any of the general forms known for photoconductive image members in the prior art, including drum, endless belt, web or plate. Referring to FIG. 1, a base 16 which can be a polyester support, a metallic or glass drum, or the like, has coated thereon a relatively thick compliant layer 13. The compliant layer has also been doped with sufficient antistatic material to be sufficiently conductive to provide a backing electrode for use in an electrophotographic process. For example, a layer of polyurethane 0.5 to 10 mm thick doped with a conventional antistat used for polyurethane transfer drums can be used. The compliant material, whether polyurethane, silicone rubber or another compliant material, should have a Young's modulus of less than $5\times10^7$ Pascals, preferably between $10^6$ and $10^7$ Pascals.

Photoconductive layer (or layers) 10, as shown, defines a chargeable surface 8 on which a toner image is formed and is coated on the compliant layer 13. It is relatively thin, for example, less than 30 microns, preferably less than 15 microns in thickness. In some applications, it is desirable to let the photoconductive layer be thinner than 15 microns, for example, 7–10 microns thick. Although other thin layers may also be present on either side of the photoconductive layer, it is desirable that the compliant layer not be greater than 30 microns from the chargeable surface 8 of the image member. Preferably, that distance is less than 15 microns and, for some applications, between 7 and 10 microns.

Alternatively, as shown in FIG. 2, a non conductive compliant layer 17, with the same characteristics as in FIG. 1, can be used with a separate conductive coating 12 which can be quite thin, for example, less than 1 micron, as is commonly used in photoconductive belts. The thin photoconductive layer 10 (with the same characteristics as in FIG. 1) is coated on conductive layer 12. Practical considerations make this the preferred embodiment.

Alternatively, as shown in FIG. 3, a compliant photoconductive layer 19 can be coated on top of a conductive layer 12 on base 16 or directly onto a conductive base such as aluminum or the like. The FIG. 3 embodiment is somewhat more difficult to make, since photoconductive and compliant characteristics must be provided in a single layer. The compliant photoconductive layer is preferably 30–100 microns thick and has a Young's modulus less than $5\times10^7$ Pascals. Preferably, it is covered by a very thin, hard layer which can be insulative or photoconductive, and which is preferably less than 5 microns thick (especially, if not photoconductive) and has a Young's modulus greater than $10^8$ Pascals. If a hard overcoat is used, the compliant photoconductive layer 19 can be more compliant, preferably having a Young's modulus less than $10^7$ Pascals. In another embodiment, the structure of FIG. 3 may include an additional layer or layers (not shown), including a compliant layer under the compliant photoconductive layer 19. In this embodiment, the preferred thickness of layer 19 may be less than 30 microns.

Although FIG. 2 shows a thin conductive layer between the photoconductive layer 10 and the compliant layer, other thin layers, such as barrier layers or protective layers, may also be present on either side of the photoconductive layer. In all the embodiments, the photoconductive layer can include one or more separate charge generation layers, charge transfer layers, and the like. The number of layers is not critical, providing they are quite thin, allowing the effects of the compliant layer to be felt by the toner and the surface to which it is transferred.

Note that the normal organic photoconductive layer is generally quite hard. For example, it may have a Young's modulus well in excess of $10^8$ Pascals, for example, $10^{10}$ Pascals or more. We have found that superior transfer can be obtained when using an image member having a compliant layer with a thin, hard photoconductive coating on top of it (with or without a very thin conductive layer between and with or without a very thin hard overcoat).

Many electrophotographic processes combine toner images made originally with different toners. Although usually these processes provide two or more different colors to an image, they can also provide images with the same color toners but with different noncolor characteristics. For example, a multiple toner image combining a nonmagnetic and a magnetic black toner would also be a "combined" toner image.

As will be seen from the examples below, forming such combined toner images is conveniently accomplished using two photoconductive image members. More specifically, first and second toner images are formed on first and second photoconductive image members, respectively. The first toner image is transferred to the second photoconductive image member in registration with the second toner image to form a combined toner image. That combined toner image can then be transferred to a receiving sheet or otherwise used. In more sophisticated versions, more than one toner image can be formed on either or both of the image members and they can be transferred to the other image member in a single step or multiple steps.

A problem with such processes is that high quality and efficient transfer of a toner image from one photoconductive image member to another photoconductive image member is difficult to achieve. Electrostatic transfer can be substantially improved if at least one of the photoconductive image members is compliant, preferably conforming to the structures described in one of FIGS. 1–3.

FIGS. 4–8 show image forming apparatus and demonstrate processes in which a compliant photoconductive image member is particularly useful. In each instance, the image forming apparatus uses two photoconductive image members, one of which is compliant. One or more toner images is formed on each photoconductive image member and one or more toner images formed on one of the photoconductive image members is transferred to the other photoconductive image member in registration with one or more of the images formed on the second photoconductive image member. Either or both of the photoconductive image members is compliant. Preferably, the photoconductive image member that receives the toner images from the other photoconductive image member is compliant, which compliance can then be used in transferring the accumulated or combined images to another surface, for example, to paper.

Referring to FIG. 4, an image forming apparatus 20 includes a first photoconductive image member 22 and a second photoconductive image member 24. Second photoconductive image member 24 includes a compliant layer 26, preferably comparable to compliant layer 13 or compliant layer 17 in FIGS. 1 and 2, respectively. First photoconductive image member 22 may also have a compliant layer, but is shown in FIG. 4 without one. Both photoconductive image members 22 and 24 have thin, hard photoconductive layers at the surface of the image members (with or without a thin, hard overcoat). These photoconductive layers are so thin (for example, 7–15 microns) they are not shown in FIGS. 4–8.

Referring to FIG. 4, first photoconductive image member 22 is uniformly charged at a charging station 28 and imagewise exposed, for example, by a laser exposing device 30 to create an electrostatic image. The electrostatic image is developed by one of first and second development stations 32 and 34 to create a first toner image.

At the same time, second photoconductive image member 24 is similarly uniformly charged at a charging station 29, imagewise exposed at an exposing station, for example, a laser exposing station 31 and developed by one of third and fourth developing stations 33 and 35 to form a second toner image on the second photoconductive image member 24.

The first toner image is transferred from the first photoconductive image member 22 to the second photoconductive image member 24 in registration with the second toner image at an electrostatic transfer nip 40. This transfer to the second photoconductive image member 24 is accomplished under an electrostatic field between the two image members controlled by a potential applied from a potential source 42, having a potential opposite to that of the toner. The first photoconductive image member 22 has a conductive layer which is grounded.

The combined toner image, i.e., the image formed when the first toner image is transferred in registration with the second toner image, is transferred in one step to a receiving sheet 36 which has been affixed to a transfer drum 38. This transfer is controlled by an electric field between members 24 and 38 controlled by a voltage source 44, applied to transfer roller 38, and voltage source 42. Both image members are cleaned by suitable cleaning devices 46 and 47, respectively, so that the process can be continuous.

Thus far, the image forming apparatus 20 has provided a combined toner image made up of first and second toner images on receiving sheet 36. Two other images may be added to this by repeating the process but using the other of toning stations 32 and 34 and toning stations 33 and 35 to form a second combined image on second photoconductive image member 24, which is then transferred in registration with the first combined toner image on receiving sheet 36 as transfer roller 38 executes another revolution.

Figure 5:
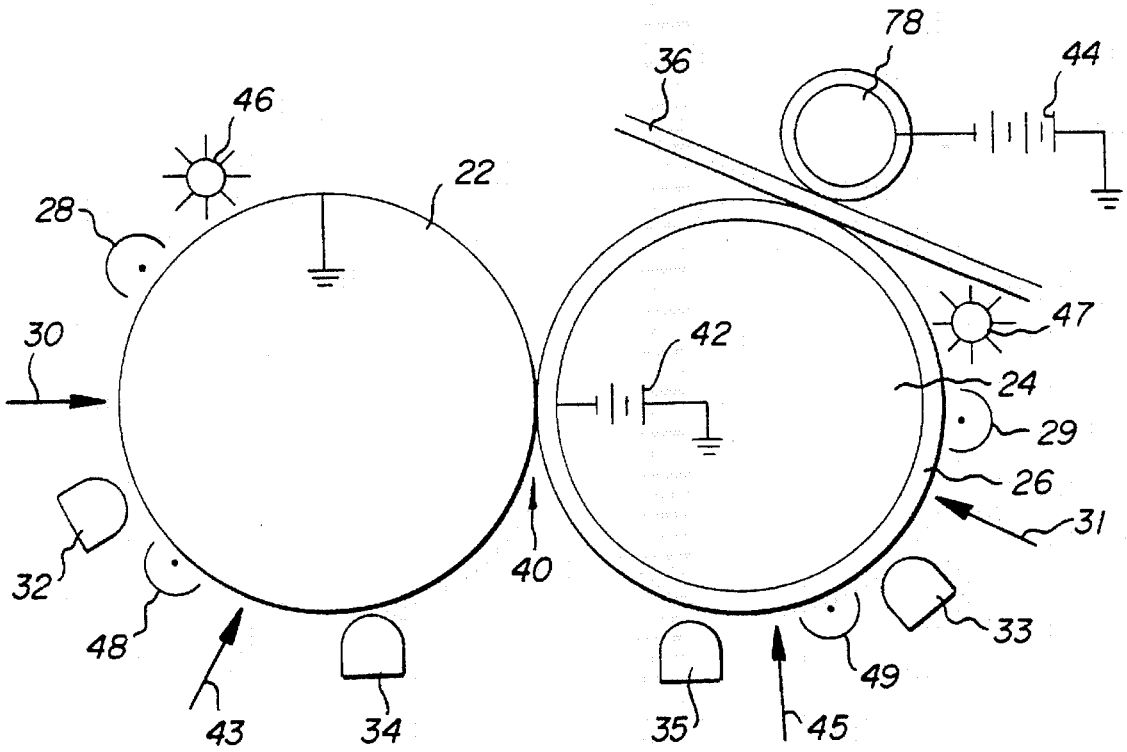

Referring to FIG. 5, a four toner combined image can be formed with increased productivity over the FIG. 4 device, by applying known technology to the FIG. 4 embodiment (see U.S. Pat. No. 5,001,028, issued Mar. 19, 1991 to Mosehauer et al). The first and second toner images as in FIG. 4 are formed by charging, exposing and developing devices 28, 30 and 32 and 29, 31 and 33, respectively. However, the third image is formed directly on top of the first image prior to transfer and the fourth toner image is formed directly on top of the second toner image prior to receiving transfer from the first photoconductive image member 22. More specifically, after the first toner image is formed on photoconductive image member 22, photoconductive image member 22 is charged by a charging station 48 and imagewise exposed by a suitable exposure device 43 to create a third electrostatic image which is then toned by third toning station 34 to create a combined toner image on photoconductive image member 22. Similarly, charging, exposing and developing stations 49, 45 and 35, respectively, are used to form another toner image on top of the second toner image already formed on image member 24. The combined toner image on image member 22 is then transferred to photoconductive image member 24 at transfer nip 40 as in FIG. 4 in registration with the combined toner image formed on image member 24 to now form a combined toner image that includes all four images. This combined toner image is transferred in a single step to receiver 36 as backed by a transfer backing roller 78.

This approach has advantages over that shown in FIG. 4 in that it can provide a four color toner image to receiving sheet 36 at full process speed and without wrapping the receiving sheet 36 around the transfer roller 38 to register images. On the other hand, this process is challenging in toning a second electrostatic image in the presence of an unfixed first toner image on each of the two photoconductive image members.

The use of two photoconductive image members, in addition to other advantages which will be set out below, in the process of FIG. 5, provides a four color image at full process speed but without toning an electrostatic image on top of more than one earlier toner image.

Figure 6:
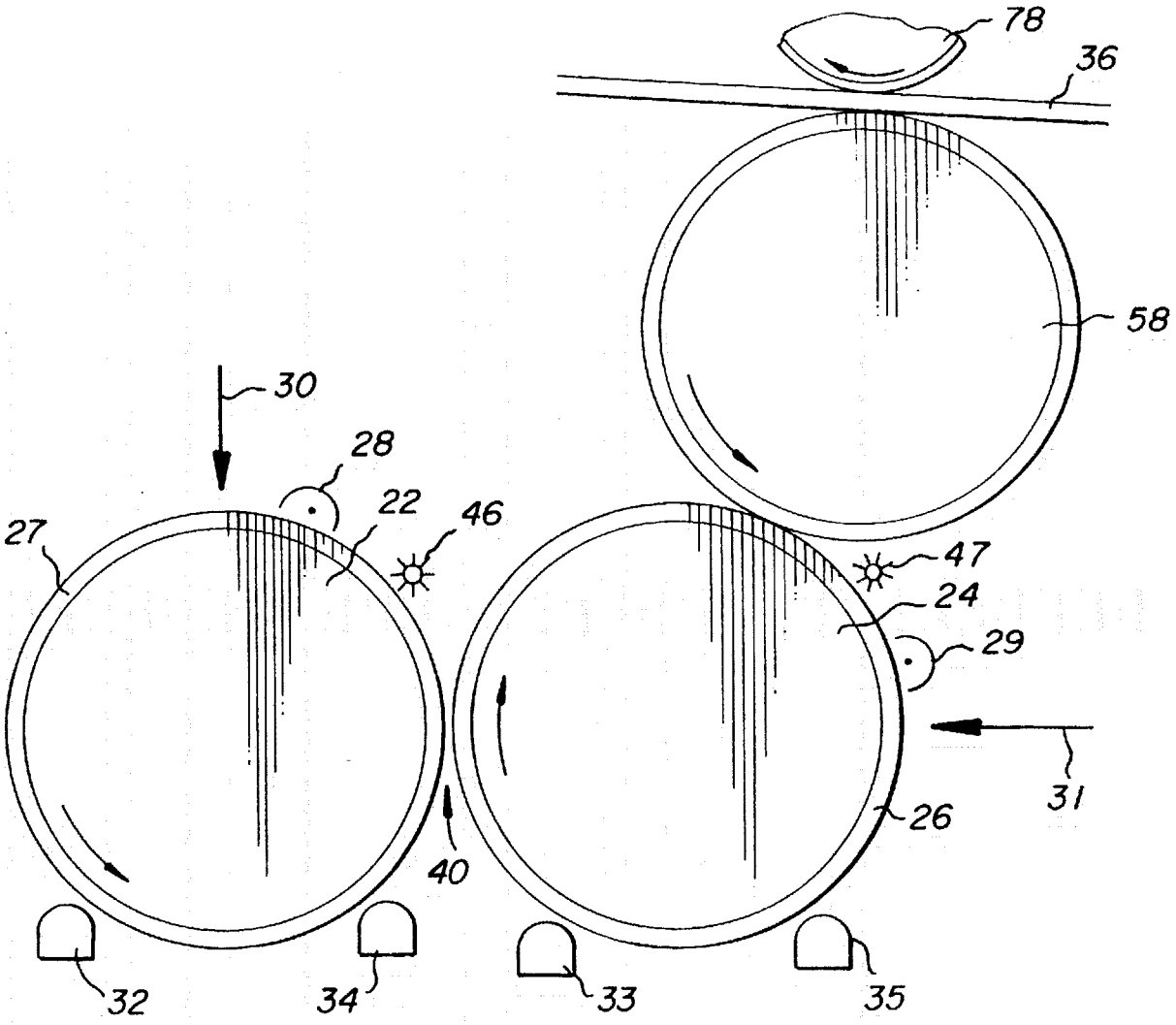

FIG. 6 shows a variation on the FIG. 4 approach with power supplies omitted for clarity. Both of the two combined toner images are formed on image member 24 as in FIG. 4. However, the first one is transferred first to an intermediate roller 58. The second combined toner image is later transferred from second photoconductive image member 24 to intermediate roller 58 in registration with the first combined toner image and the four image combined image is then transferred from intermediate roller 58 to receiving sheet 36 in a single step.

A compliant layer 27 is shown on first photoconductive image member 22, as well as the compliant layer 26 on photoconductive image member 24. The use of compliance in both photoconductive image members further increases the size of the nip 40 improving electrostatic transfer there. A compliant layer is also shown in intermediate roller 58 which improves the transfer of the combined toner image to the receiving sheet 36. Transfer backing roller 78 (articulatable in this embodiment) supports sheet 36 during transfer to it. Although compliance is shown on all three members 22, 24 and 58, less than all three could be compliant and still obtain the advantages of the invention, for example, member 58, with either 22 or 24, provides excellent results.

Figure 7:
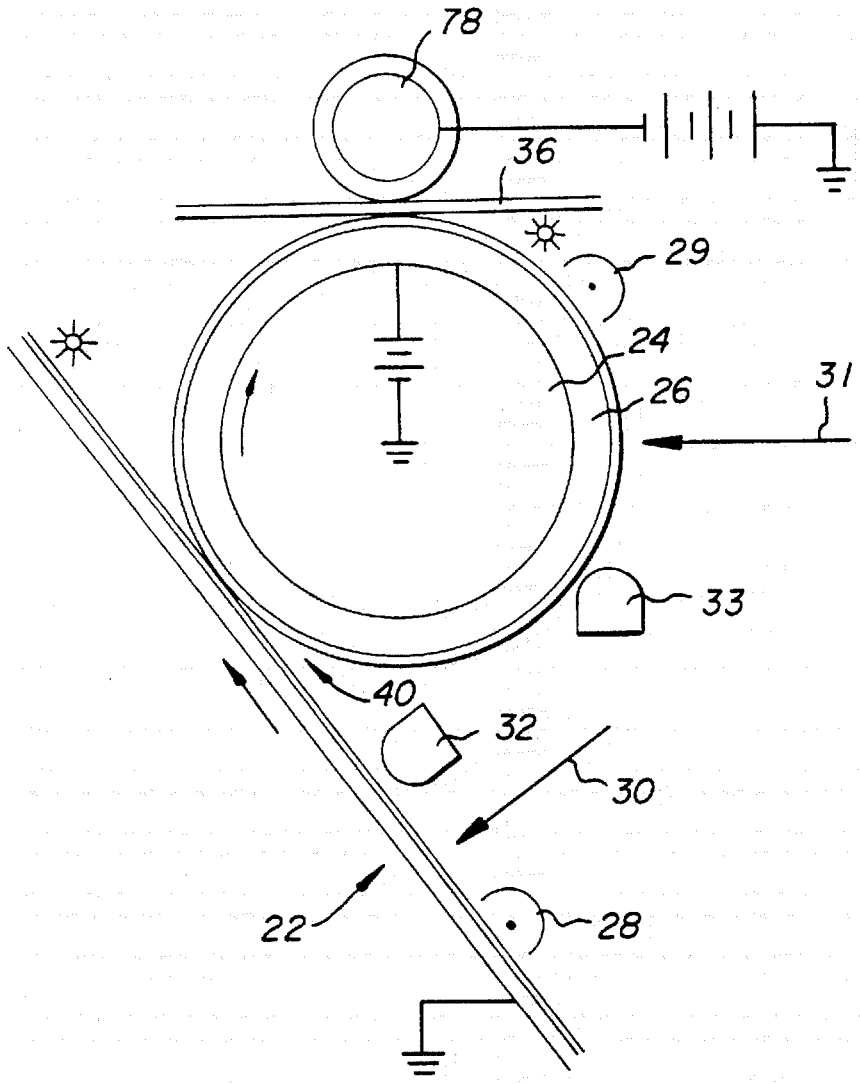

FIG. 7 shows a two color embodiment similar to that shown in FIG. 4 in which the first photoconductive image member 22 is a belt and the second photoconductive image member 24 is a drum. In this instance, the process is set up primarily to do single color accent color imaging. That is, toning station 33 tones the electrostatic images formed on the second photoconductive image member 24 with black toner and is the primary image member used in the image forming apparatus. When accent color is desired along with the black first color, the first photoconductive image member 22 is utilized to provide, for example, a red toner image which is transferred in registration with the black toner image at nip 40 to form the combined toner image on second photoconductive image member 24. As in some of the other embodiments, the combined toner image is transferred in a single step to the receiving sheet 36 backed by transfer backing roller 78. It is important that one or both of the image members 22 and 24 are compliant as described in FIGS. 1–3 to facilitate transfer at nip 40. If image member 24 is compliant (preferred), that compliance helps in the transfer to paper 36 by conforming to the roughness of the paper.

Figure 8:
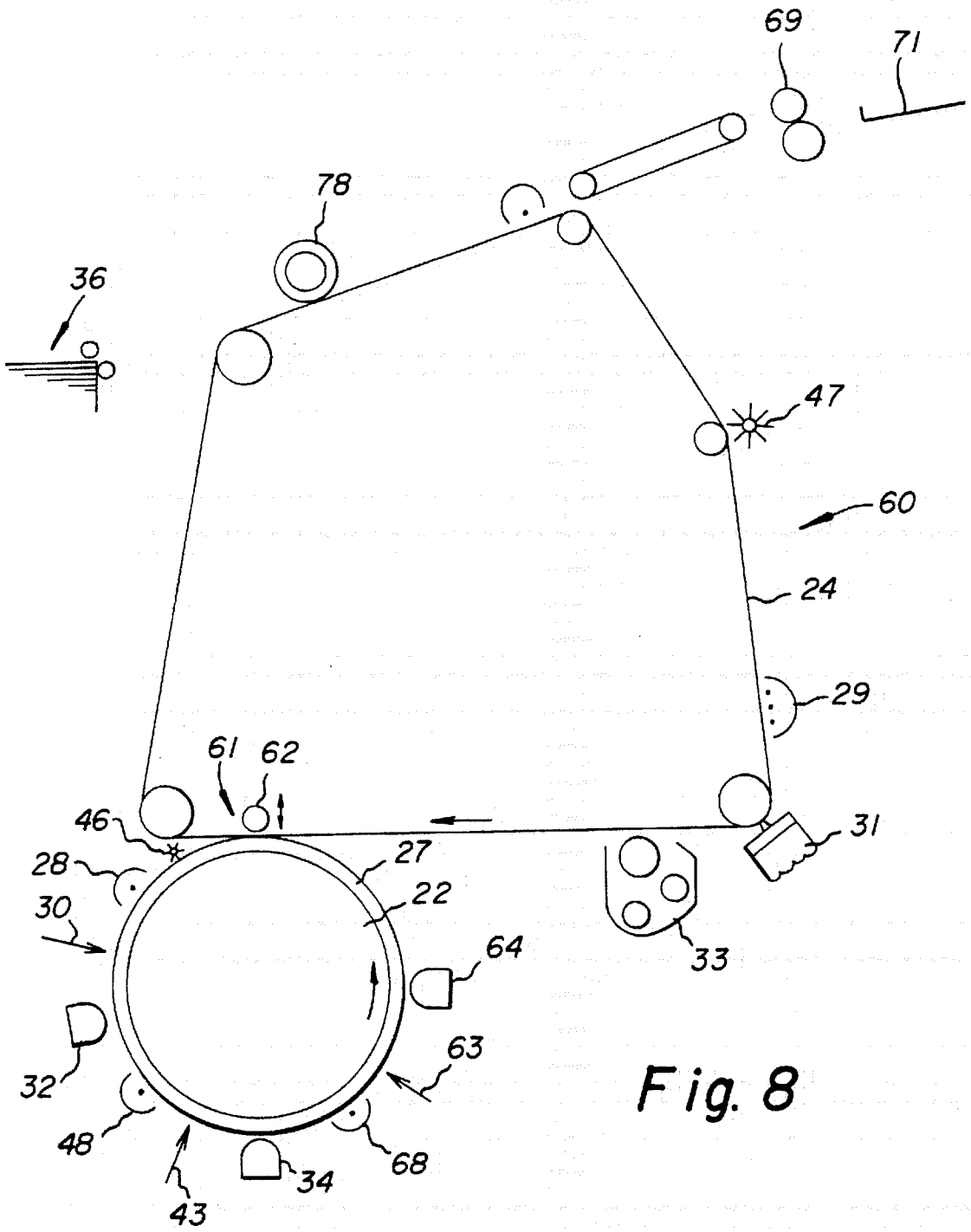

FIG. 8 shows a large high volume image forming apparatus, for example, a printer or a copier 60, in which the invention can advantageously be used. Referring to FIG. 8, and following the nomenclature of the earlier FIGS., the second photoconductive image member 24 is in the form of an endless belt trained about a series of rollers to continuously provide black images at high speed. It is charged by charging station 29, imagewise exposed by exposing station 31, shown as an LED printhead, to create electrostatic images. Each image is toned by a toning station 33 which, preferably, applies black toner to the image. In much operation the black image alone is transferred to the receiving sheet 36 using transfer backing roller 78. The receiving sheet is separated from the second photoconductive image member 24 and transported to fuser 69 and ultimately deposited in output tray 71.

For accent color images the first photoconductive image member 22 is in the form of a drum. Utilizing the same process used with respect to the structure shown in FIG. 5, either one, two or three accent color images can be formed in the same frame on image member 22. That one image or combination of images is then transferred in a single step in registration with the black image already on the second photoconductive image member 24 at transfer station 61. A backing roller 62 can be movable vertically, as shown, to urge the second photoconductive image member 24 into transfer relation with the first photoconductive image member 22 when accent color images are being made or to allow the tension of member 24 to position it slightly separated from member 22 when only black images are being made.

According to the invention, in FIG. 8 at least one of the two photoconductive image members is compliant. In FIG. 8 that compliance is shown in the first photoconductive image member 22 as compliant layer 27.

This structure provides three color accent colors at full process speed with a black core engine that is designed for high volume use in making black images. In addition to its other advantages, it has the advantage of being readily adapted to modular type construction with the accent color feature being added to the primary black engine when desired by the customer.

If the second photoconductive image member 24 is compliant, in addition to assisting transfer at nip 61, such compliance also assists transfer to paper or another receiving sheet at backing roller 78.

In all of the above examples the compliant layer on a photoconductive image member having that layer should have a Young's modulus less than $5\times10^7$ Pascals, preferably much less, for example, $10^6$ to $10^7$ Pascals. For best results in transfer at nip 40 the photoconductive layer overlying the compliant layer should be as thin as possible and still maintain sufficient photographic speed for the process and should be significantly harder than the compliant underlayer. Although a photoconductive layer 15 to 30 microns thick having a Young's modulus in excess of $10^8$ Pascals provides excellent results, even further improvement can be obtained if the photoconductor is somewhat thinner, for example, as thin as 7 to 15 microns.

In addition to the many advantages mentioned above, when the FIGS. 4–7 embodiments are used with two drums, combining two, three or four images, registration is considerably easier than when two separate photoconductive image members are used to transfer to a third member, for example, an intermediate or a receiving sheet, as is known in the prior art.

Note that the second photoconductive image member functions both as an imaging photoconductive member and as an intermediate to receive an image made elsewhere. It, thus, has a bi-functional property in the process. It is preferably compliant, although some of the examples show the first photoconductive image member being compliant instead of or in addition to the second photoconductive image member.

When the first photoconductive image member is compliant, it can provide electrostatic transfer advantages, especially when transferring to a non-compliant, non-photoconductive member such as a hard intermediate member or a hard receiver (for example, glass, metal or paper). When transferring directly to paper or other hard surfaces, a "microconformance" is provided by the FIGS. 1–3 structures that ensures thorough toner-paper contact which helps provide efficient transfer. It also helps transfer in the vicinity of carrier particles and other debris that occasionally are present in the transfer nip, and greatly reduces "hollow character" problems in such transfer. If this is used for full color reproductions, the microconformance helps provide such contact despite substantial variation in toner stack height typical of multiple color images. Thus, a compliant photoconductive image member has general use in electrostatic transfer, regardless of the member transferred to.

The invention has been described in detail with particular reference to a preferred embodiment thereof, but it will be understood that variations and modifications can be effected within the spirit and scope of the invention as described hereinabove and as defined in the appended claims.

We claim:

1. Image forming apparatus comprising:

first and second photoconductive image members, means for forming a first toner image on the first photoconductive image member, means for forming a second toner image on the second photoconductive image member, means for transferring the first toner image from the first photoconductive image member to the second photoconductive image member in registration with the second toner image, wherein at least one of the first or second photoconductive image members is compliant.

2. The image forming apparatus according to claim 1 wherein the second photoconductive image member is compliant.

3. The image forming apparatus according to claim 2 wherein the compliant photoconductive image member has a compliant layer of material having a Young's modulus less than $5\times10^7$ Pascals and a photoconductive layer having a Young's modulus of $10^8$ Pascals or greater.

4. The image forming apparatus according to claim 3 wherein the compliant layer is not greater than 30 microns from a chargeable surface of the photoconductive image member.

5. The image forming apparatus according to claim 2 wherein one of the first and second photoconductive image members is a belt and the other photoconductive image member is a drum.

6. The image forming apparatus according to claim 2 wherein the second toner image is black and the first toner image is a color other than black.

7. The image forming apparatus according to claim 2 and including means for transferring the first toner image and the second toner image from the second photoconductive image member to a receiver sheet.

8. The image forming apparatus according to claim 1 wherein both said first and said second photoconductive image members are compliant.

9. The image forming apparatus according to claim 1 wherein the compliant photoconductive image member has a compliant layer of material having a Young's modulus less than $5\times10^7$ Pascals and a photoconductive layer having a Young's modulus of $10^8$ Pascals or greater and the compliant layer is not greater than 30 microns from a chargeable surface of the photoconductive image member.

10. The image forming apparatus according to claim 9 wherein the photoconductive layer is less than 30 microns thick.

11. The image forming apparatus according to claim 10 wherein the photoconductive layer is less than 15 microns thick.

12. The image forming apparatus according to claim 11 wherein the compliant layer is at least 0.5 mm thick.

13. The image forming apparatus according to claim 1 wherein the photoconductive image member which is compliant includes a compliant layer of material having a Young's modulus of less than $5\times10^7$ Pascals and a photoconductive layer having a Young's modulus of $10^8$ Pascals or greater and a conductive layer positioned between the compliant layer and the photoconductive layer.

14. The image forming apparatus according to claim 13 wherein the photoconductive layer is less than 30 microns thick.

15. The image forming apparatus according to claim 1 wherein the second photoconductive image member includes a compliant photoconductive layer that has a Young's modulus less than $5\times10^7$ Pascals.

16. The image forming apparatus according to claim 1 wherein the means for forming the first toner image includes an exposure source positioned to image-wise expose the first photoconductive image member to form a first electrostatic image and a development station for developing the electrostatic image; and the means for forming a second toner image includes an exposure source positioned to image-wise expose the second photoconductive image member to form a second electrostatic image and a development station for developing the second electrostatic image.

17. The image forming apparatus according to claim 16 wherein the second photoconductive image member is compliant.

18. The image forming apparatus according to claim 17 and including means for transferring the first toner image and the second toner image from the second photoconductive image member to a receiver sheet.

19. A method of providing combined toner images comprising:

forming a first toner image on a first photoconductive image member, forming a second toner image on a second photoconductive image member, at least one of the photoconductive image members being compliant, transferring the first toner image from the first photoconductive image member to the second photoconductive image member in registration with the second toner image to form a combined toner image.

20. The method according to claim 19 wherein said transferring step includes forming a nip between the two photoconductive image members and applying an electric field of a direction urging the first toner image to transfer to the second photoconductive image member.

21. The method according to claim 20 further including the step of transferring the combined toner image from the second photoconductive image member to a receiving sheet.

22. The method according to claim 20 wherein the first and second toner images are of different colors.

23. The method according to claim 22 wherein the combined toner image is transferred to a receiving surface and the process is repeated with the first and second image members except that toner images made from third and fourth color toners are formed on the first and second photoconductive image members to form another combined toner image which is transferred to the receiving surface in registration with the first combined toner image.

24. The method according to claim 23 wherein the receiving surface is defined by an intermediate image member.

25. The method according to claim 19 wherein the second toner image is black and the second photoconductive image member is an endless belt and the first toner image is a color other than black and the first photoconductive image member is a drum.

26. The method according to claim 19 further including the step of transferring the combined toner image from the second photoconductive image member to a receiver sheet.

27. The method according to claim 26 wherein the second photoconductive image member is compliant.

28. The method according to claim 27 wherein the compliant photoconductive image member has a compliant layer of material having a Young's modulus less than $5\times10^7$ Pascals and a photoconductive layer having a Young's modulus of $10^8$ Pascals or greater.

29. The method according to claim 28 wherein the compliant layer is not greater than 30 microns from a chargeable surface of the photoconductive image member.

30. The method according to claim 27 wherein the second photoconductive image member includes a compliant photoconductive layer that has a Young's modulus less than $5\times10^7$ Pascals.

31. A method of forming multicolor toner images comprising:

forming a first toner image on a first photoconductive image member, without transferring the first toner image, forming a second toner image on the first photoconductive image member in registration with the first toner image, which second toner image is of a second color different from the first color, forming a third toner image of a third color different from the first and second colors on a compliant second photoconductive image member, without transferring the third tonor image, forming a fourth toner image in registration with the third toner image which fourth toner image is of a fourth color different from the first, second and third colors, transferring the combined first and second toner images to the second photoconductive image member in registration with the third and fourth toner images to form a four color toner image on the second photoconductive image member; and transferring the four color toner image to a receiver sheet.

32. The method of claim 31 wherein the compliant photoconductive image member has a compliant layer of material having a Young's modulus less than $5\times10^7$ Pascals and a photoconductive layer having a Young's modulus of $10^8$ Pascals or greater.

33. Image forming apparatus comprising:

a first photoconductive image member, a second photoconductive image member, the second photoconductive image member being compliant, means for forming a first toner image on the second photoconductive image member, means for forming a second toner image on the first photoconductive image member, means for transferring the second toner image from the first photoconductive image member to the second photoconductive image member in registration with the first toner image to form a combined toner image, and means for transferring the combined toner image to a receiving sheet.

34. The image forming apparatus according to claim 33 including means for forming a third toner image in a color other than colors of the first and second toner images on the first photoconductive image member in registration with the second toner image and means for transferring the third toner image to the second photoconductive image member with transfer of the second toner image to become part of the combined toner image.

35. Image forming apparatus comprising:

first and second photoconductive image members, the second photoconductive image member being a compliant image member, means for forming a first toner image of a first color on an image area of the first image member and means for forming a second toner image of a second color in the same image area in registration with the first toner image, means for forming a third toner image of a third color on an image area of the second image member and means for forming a fourth toner image in the same image area and in registration with the third toner image, means for transferring the first and second toner images to the second image member in registration with the third and fourth toner images to form a four color toner image, and means for transferring the four color toner image to a receiver sheet.

36. The image forming apparatus according to claim 35 and wherein the compliant photoconductive image member has a compliant layer of material having a Young's modulus less than $5\times10^7$ Pascals and a photoconductive layer having a Young's modulus of $10^8$ Pascals or greater.

37. The image forming apparatus according to claim 36 wherein the first photoconductive image member is a compliant image member.

38. The image forming apparatus according to claim 35 wherein the compliant photoconductive image member has a compliant layer of material having a Young's modulus less than $5\times10^7$ Pascals and a photoconductive layer having a Young's modulus of $10^8$ Pascals or greater and the compliant layer is not greater than 30 microns from a chargeable surface of the photoconductive image member.

39. The image forming apparatus according to claim 38 wherein a conductive layer is positioned between the compliant layer and the photoconductive layer.

* * * * *

UNITED STATES PATENT AND TRADEMARK OFFICE

CERTIFICATE OF CORRECTION

PATENT NO. : 5,715,505
INVENTOR(S) : Thomas N. Tombs, et. al.
DATED : February 3, 1998

It is certified that error appears in the above-identified patent and that said Letters Patent is hereby corrected as shown below:

On the Title page, insert the following, under Related U.S. Application Data:

[60] Provisional application No. 60/006.428, filed Nov. 13, 1995.

Column 1, line 5, insert the following:

--CROSS REFERENCE TO RELATED APPLICATION

Reference is made to and priority claimed from U.S. provisional application Ser. No. U.S. 60/006,428, filed Nov. 13, 1995, entitled IMAGE FORMING METHOD ANDAPPARATUS UTILIZING A COMPLIANT IMAGE MEMBER.

Signed and Sealed this

Twentieth Day of July, 1999

*Attest:*

*Attesting Officer*

Q. TODD DICKINSON

*Acting Commissioner of Patents and Trademarks*